US010641049B2

(12) United States Patent
Yang et al.

(10) Patent No.: US 10,641,049 B2
(45) Date of Patent: May 5, 2020

(54) RISER STUB FOR ACOUSTIC RESONANCE DECOMPOSITION OF HYDRATE IN DEEPWATER DRILLING

(71) Applicant: China University of Petroleum-Beijing, Beijing (CN)

(72) Inventors: Jin Yang, Beijing (CN); Qishuai Yin, Beijing (CN); Shanshan Shi, Beijing (CN); Chunwei Gu, Zhanjiang (CN); Haodong Chen, Zhanjiang (CN); Hexing Liu, Zhanjiang (CN)

(73) Assignee: China University of Petroleum-Beijing, Beijing (CN)

( * ) Notice: Subject to any disclaimer, the term of this patent is extended or adjusted under 35 U.S.C. 154(b) by 0 days.

(21) Appl. No.: 16/436,065

(22) Filed: Jun. 10, 2019

(65) Prior Publication Data

US 2020/0080386 A1 Mar. 12, 2020

(30) Foreign Application Priority Data

Sep. 10, 2018 (CN) ..... 2018 1 1049811

(51) Int. Cl.
*E21B 17/01* (2006.01)
*E21B 33/038* (2006.01)
*E21B 43/36* (2006.01)

(52) U.S. Cl.
CPC ..... *E21B 17/01* (2013.01); *E21B 33/038* (2013.01); *E21B 43/36* (2013.01)

(58) Field of Classification Search
CPC ..... E21B 17/01; E21B 33/038; E21B 43/36
See application file for complete search history.

(56) References Cited

U.S. PATENT DOCUMENTS 6,644,848 B1 * 11/2003 Clayton ..... E21B 17/01 374/7
6,880,402 B1 * 4/2005 Couet ..... B08B 3/12 73/579

(Continued)

FOREIGN PATENT DOCUMENTS

CN 202402010 A 8/2012
CN 203808886 A 9/2014

(Continued)

OTHER PUBLICATIONS

Technology of removing near wellbore inorganic scale damage by high power ultrasonic treatment, petroleum exploration and development, vol. 38, No. 2.

(Continued)

*Primary Examiner* — James G Sayre
*Assistant Examiner* — Aaron L Lembo
(74) *Attorney, Agent, or Firm* — Young Basile Hanlon & MacFarlane, P.C.

(57) ABSTRACT

A riser stub for acoustic resonance decomposition of hydrate in deepwater drilling, comprising a through tubular stub body, a plurality of acoustic transducers being fixedly disposed on an outer wall surface of the tubular stub body; an outer side of the tubular stub body being covered with a water insulation layer, the plurality of acoustic transducers being sealed between the tubular stub body and the water insulation layer, the water insulation layer being further provided with a power-on interface that can be connected to a power supply, the plurality of acoustic transducers being connected to the power-on interface. A riser stub for acoustic resonance decomposition of hydrate in deepwater drilling, through continuous power-on, sound waves close to a simple harmonic vibration frequency of the hydrate are generated inside the pipeline to cause the hydrate in the riser to resonate, thereby being able to effectively avoid formation (Continued)

of hydrate inside the pipeline; after the hydrate is formed inside the pipeline, the acoustic transducers of the riser stub are energized, by means of the acoustic waves, the hydrate blocking the pipeline is caused to resonate to break its equilibrium state and to be decomposed so as to realize de-blocking.

12 Claims, 2 Drawing Sheets

(56) References Cited

U.S. PATENT DOCUMENTS

| | | | | |
|---|---|---|---|---|
| 9,983,037 | B2 * | 5/2018 | Edward | G01F 1/662 |
| 10,107,786 | B2 * | 10/2018 | Fan | G01F 1/662 |
| 2013/0327533 | A1 * | 12/2013 | Veeningen | E21B 47/1025 166/345 |
| 2018/0147611 | A1 * | 5/2018 | Carson | B08B 9/027 |

FOREIGN PATENT DOCUMENTS

| | | | |
|---|---|---|---|
| CN | 206495652 | A | 9/2017 |
| CN | 206824341 | A | 1/2018 |
| WO | 2011/145979 | A1 | 11/2011 |

OTHER PUBLICATIONS

The Optimization of Structural Parameters of the Oil Production Increasing Ultrasonic Transducer Based on Electromechanical Coupling, Dissertation for the Master Degree in Engineering, Jun. 2014.
Special PCT Search Report, dated Mar. 19, 2019.

* cited by examiner

RISER STUB FOR ACOUSTIC RESONANCE DECOMPOSITION OF HYDRATE IN DEEPWATER DRILLING

TECHNICAL FIELD

The invention relates to an offshore deepwater drilling equipment, in particular to a riser stub for acoustic resonance decomposition of hydrate in deepwater drilling.

BACKGROUND

With further development of offshore oil and gas resources, key areas for oil and gas exploration and development have gradually shifted from land and offshore shallow water areas to far-sea and deepwater areas. On one hand, during oceanic deepwater drilling-in, due to the high-pressure and low-temperature environmental conditions near mudline, it is easy to cause fluid in a pipe string and equipment to form hydrate, thereby blocking the pipe string and preventing the fluid from circulating; on the other hand, due to deepwater depth in the deepwater drilling areas, once the hydrate is formed inside underwater pipe string to cause blockage, it is difficult to de-block the inside of the pipe string to recover in-well circulation. When hydrate blockage occurs in the underwater pipe string and equipment, it will greatly affect the drilling operation efficiency and increase drilling operation cost. For deepwater drilling, main locations where hydrate blockage is extremely easy to form include: one is a riser near an upper end of an underwater wellhead and the other is a riser section cooperating with a lower part of the underwater wellhead, part of the riser section is above mud surface, the other part is below the mud surface.

For on-site deepwater drilling, hydrate formation in an inner passage of the drilling pipe string and equipment is usually inhibited by injecting thermal fluid, kinetic or thermodynamic inhibitors into the well, but the current method can only play a preventive role and can not completely prevent the formation of hydrate in the pipe string and equipment, and cost of the kinetic or thermodynamic inhibitors used on the site is very high, and such additives are not environmentally friendly products and easily pollutes the marine environment, thus causing irreparable damage to the marine ecosystem. After the hydrate has been formed and blocked a circulation channel, there is no effective, economical and environmentally friendly method to remove the blockage. Therefore, it is quite necessary to develop an economical, efficient and environmentally friendly tool to solve the problem of hydrate blockage near the deepwater drilling mudline.

Therefore, based on many years of experience and practice in related industries, the inventor of the present invention provides a riser stub for acoustic resonance decomposition of hydrate in deepwater drilling to overcome the defects of the prior art.

SUMMARY OF THE INVENTION

An object of the present invention is to provide a riser stub for acoustic resonance decomposition of hydrate in deepwater drilling, which can be used for de-blocking after hydrate is formed inside a deepwater drilling circulation channel.

Another object of the present invention is to provide a riser stub for acoustic resonance decomposition of hydrate in deepwater drilling, the riser stub being capable of preventing hydrate formation.

The object of the invention is achieved by a riser stub for acoustic resonance decomposition of hydrate in deepwater drilling, comprising a through tubular stub body, wherein the tubular stub body includes a first and second connection ends connected to the riser at both ends thereof, respectively; wherein a plurality of acoustic transducers are fixedly disposed on an outer wall surface of the tubular stub body; wherein an outer side of the tubular stub body is covered with a water insulation layer, and the plurality of acoustic transducers are sealed between the tubular stub body and the water insulation layer; and wherein the water insulation layer is further provided with a power-on interface that can be connected to a power supply, and the plurality of acoustic transducers are connected to the power-on interface.

From the above mentioned, after the riser stub for acoustic resonance decomposition of hydrate in deepwater drilling is adopted, through continuous power-on, sound waves close to a simple harmonic vibration frequency of the hydrate are generated inside the pipeline to cause the hydrate in the riser to resonate, thereby being able to effectively avoid (prevent) formation of natural gas hydrate inside the pipeline; after the natural gas hydrate has been formed inside the pipeline, a power supply system of the riser stub will automatically start supplying power to the acoustic transducers, or the riser stub may be temporarily energized via a cable, by means of the acoustic waves, the natural gas hydrate blocking the pipeline is caused to resonate to break its equilibrium state and to be decomposed so as to realize de-blocking.

BRIEF DESCRIPTION OF THE DRAWINGS

The following drawings are intended only to schematically illustrate and explain the invention and do not limit the scope of the invention. Among the drawings.

DETAILED DESCRIPTION OF THE PREFERRED EMBODIMENTS

Hereinafter the technical solution in the embodiments of the present invention will be described clearly and integrally in combination with the accompanying drawings in the embodiments of the present invention, and obviously the described embodiments are merely part of the embodiments, not all of the embodiments. Based on the embodiments of the present invention, all other embodiments that are obtained by persons skilled in the art without making creative efforts fall within the protection scope of the present invention.

Figure 1:
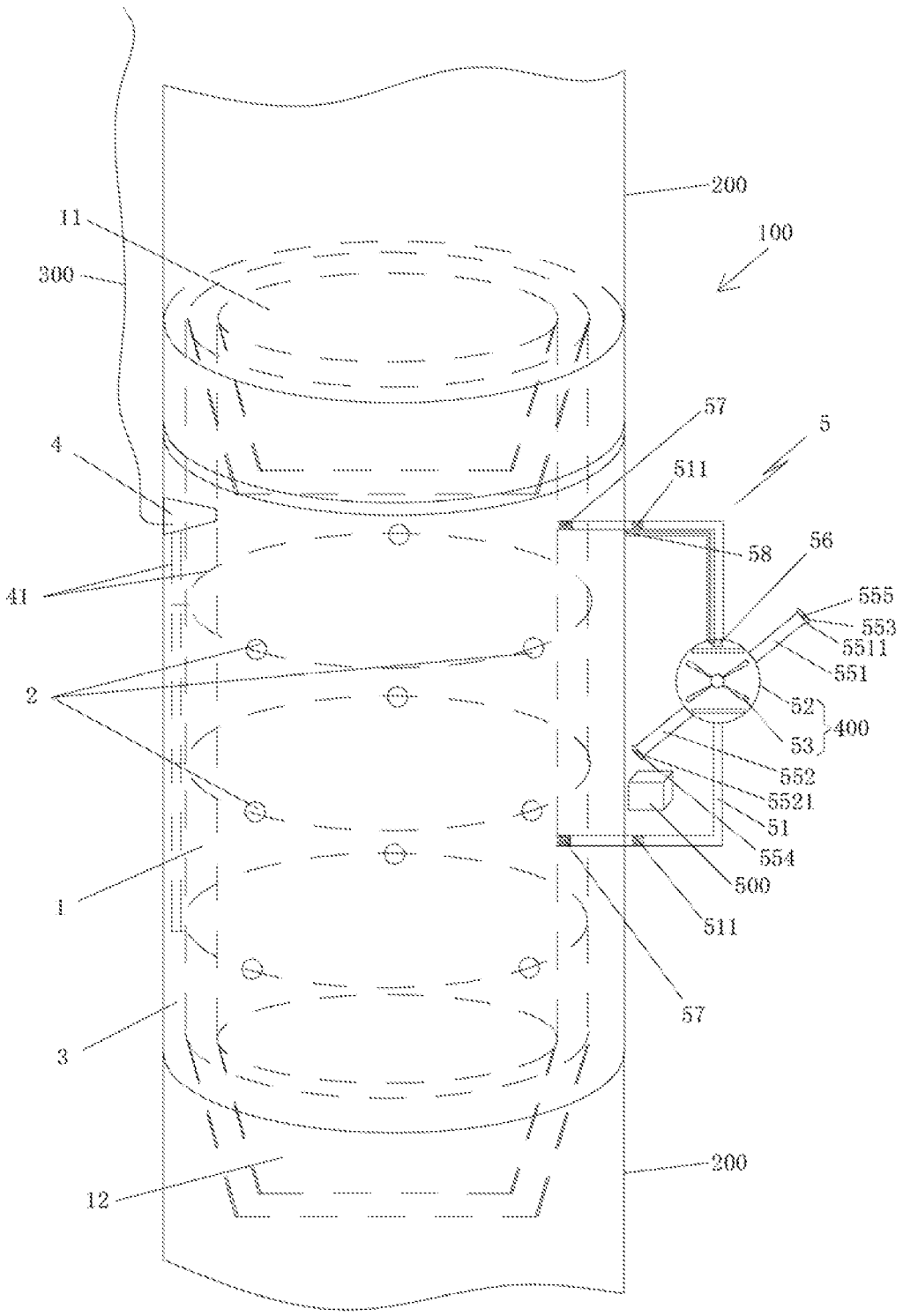
FIG. 1 is a first structural schematic of a riser stub for acoustic resonance decomposition of hydrate in deepwater drilling according to the present invention.

Unless directions separately defined, upper and lower directions involved in the specifications all take the upper and lower directions shown in FIG. 1 of the present invention as the criterion and are also described herein.

Figure 2:
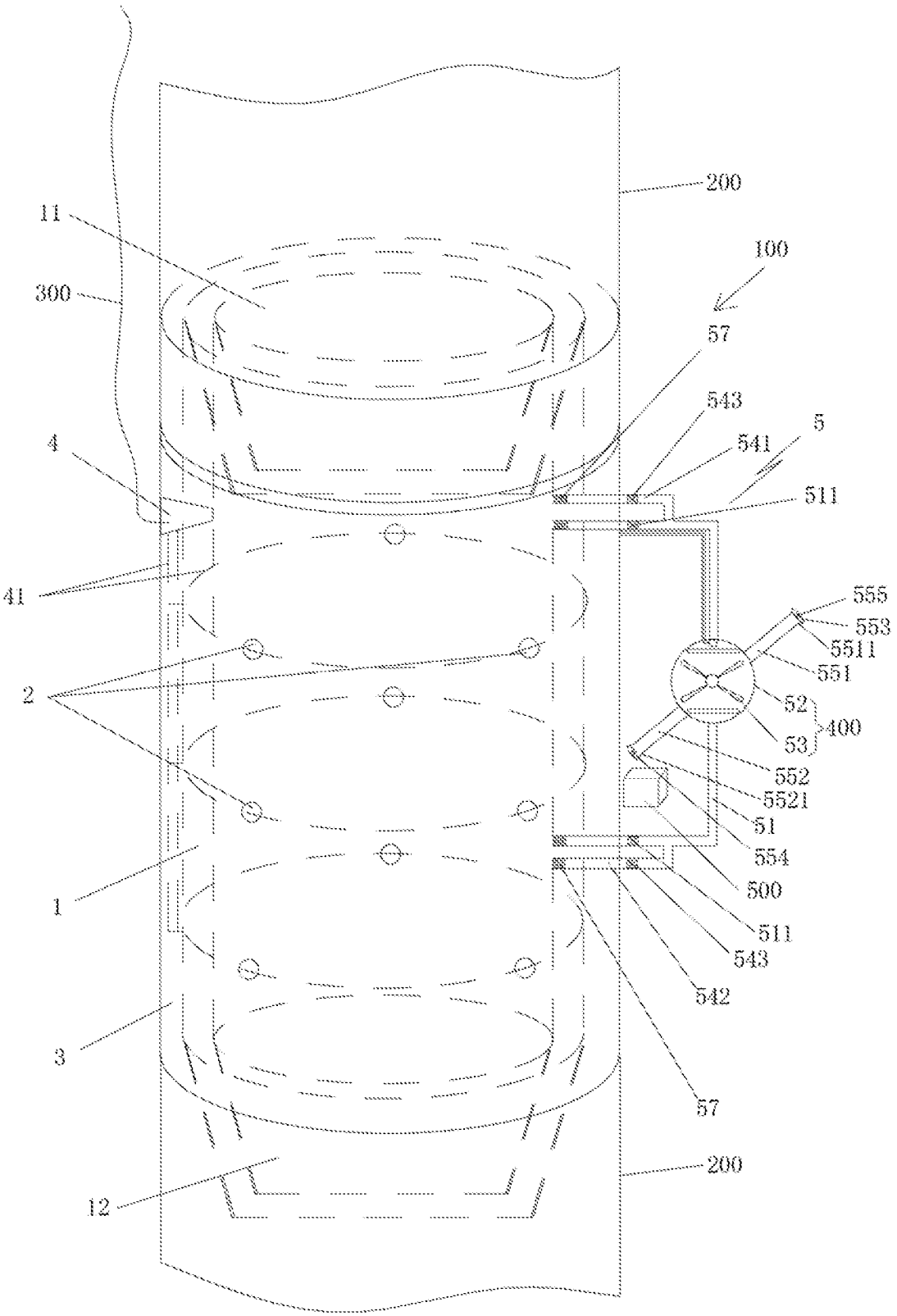
FIG. 2 is a second structural schematic of a riser stub for acoustic resonance decomposition of hydrate in deepwater drilling according to the present invention.

As shown in FIGS. 1 and 2, the present invention provides a riser stub 100 for acoustic resonance decomposition of hydrate in deepwater drilling, comprising a through tubular stub body 1, wherein the tubular stub body 1 includes a first and second connection ends 11, 12 connected to the riser 200 at both ends thereof, respectively; wherein a plurality of acoustic transducers 2 are fixedly disposed on an outer wall surface of the tubular stub body 1; wherein an outer side of the tubular stub body 1 is covered with a water insulation layer 3, in the embodiment, the water insulation layer 3 is a ceramic insulation layer; the plurality of acoustic transducers 2 are sealed between the tubular stub body 1 and the water insulation layer 3, the water insulation layer 3 is further provided with a power-on interface 4 that can be connected to a power supply, and the plurality of acoustic transducers 2 are connected to the power-on interface 4 through a wire 41.

The riser stub for acoustic resonance decomposition of hydrate in deepwater drilling according to the present invention may be connected between the risers in the form of one or more segments, or a riser stub of a suitable length may be selected to be installed at a position where hydrate blockage is easily formed, after the hydrate is formed inside the circulation channel, the acoustic resonance decomposition function of the riser stub for acoustic resonance decomposition of hydrate in deepwater drilling according to the present invention can realize de-blocking, and at the same time, formation of the hydrate can be prevented.

After the riser stub for acoustic resonance decomposition of hydrate in deepwater drilling according to the present invention is energized, the acoustic transducers generate sound waves of a specific frequency range and the sound waves are spread to the inside of the pipe body through the stub body, when the frequency of the sound waves approaches or reaches the simple harmonic vibration frequency of the hydrate inside the pipe body, resonance phenomenon of hydrate molecules will be caused, thereby accelerating decomposition of the hydrate.

After the above-mentioned riser stub is adopted, through continuous power-on, sound waves close to a simple harmonic vibration frequency of the hydrate are generated inside the pipeline to cause the hydrate in the riser to resonate, thereby being able to effectively avoid (prevent) formation of natural gas hydrate inside the pipeline; after the natural gas hydrate has been formed inside the pipeline, a power supply system of the riser stub will automatically start supplying power to the acoustic transducers, or the riser stub may be temporarily energized via a cable, by means of the acoustic waves, the natural gas hydrate blocking the pipeline is caused to resonate to break its equilibrium state and to be decomposed so as to realize de-blocking. The on-site application of the riser stub for acoustic resonance decomposition of hydrate in deepwater drilling according to the present invention has important practical significance for safe drilling engineering.

In the embodiment, as shown in FIG. 1, the acoustic transducers 2 are provided in a plurality of groups (acoustic transducers 2 on the same horizontal plane belong to one group) at intervals along a length direction (i.e., an axial direction) of the tubular stub body 1, in each group, the acoustic transducers 2 are evenly distributed along a circumferential direction of the tubular stub body 1; for example, three acoustic transducers 2 in the same group (on the same horizontal plane) are arranged at 120 degrees apart. The acoustic transducers 2 are fixed on the outer wall surface of the tubular stub body 1 by high temperature resistant glue; or may be fixed by other existing technologies.

The power supply may be an external cable 300 extending downward from a water surface drilling platform (not shown). The external cable is connected with the power-on interface 4 through underwater ROV to energize the acoustic transducers 2 of the riser stub; by adjusting frequency and current of the power supply current on the platform, the frequency range of the sound waves generated by the acoustic transducers can be precisely and conveniently controlled, so as to ensure strength and safety of the pipe body itself, and at the same time to cause the natural gas hydrate formed in the pipe to be decomposed, thereby realizing smooth de-blocking and restoring the in-well circulation.

In the embodiment, as shown in FIG. 1, the power supply may also be a power supply system 5 disposed outside the tubular stub body 1. The power supply system 5 includes a by-pass pipeline 51, one end of which is fixedly communicated with an upper end inner cavity of the tubular stub body 1, and the other end of which is fixedly communicated with a lower end inner cavity of the tubular stub body 1. One end and the other end of the by-pass pipeline 51 are respectively provided with a first undirectional gate valve 511, and an opening direction of the first undirectional gate valve 511 is that fluid flows from the other end of the by-pass pipeline 51 to the one end thereof (i.e.: the fluid flows from a lower end of the tubular stub body 1 to an upper end of the tubular stub body 1 through the by-pass pipeline 51), the first undirectional gate valve 511 is provided with a first opening pressure; a sealed housing 52 is arranged in the middle of the by-pass pipeline 51, and an impeller 53 of a water-wheel power generation device 400 is arranged within the sealed housing 52; the water-wheel power generation device is connected to a power transmission interface 58, which is sealably connected to the power-on interface 4.

Because a riser stub of a suitable length is selected and installed at a position where hydrate blockage is easily formed, the hydrate is usually formed between an upper end and a lower end of the tubular stub body 1, after the hydrate is formed inside the circulation channel, upward return flow of the drilling fluid through an annular space of the tubular stub body 1 is blocked, and since the fluid in the annular space has a certain pressure and a suffocating phenomenon occurs, the fluid will enter the by-pass pipeline 51 through the lower end of the tubular nipple body 1; when the fluid pressure reaches the first opening pressure set by the first unidirectional gate valve 511, the first unidirectional gate valve 511 opens unidirectionally, the fluid passes through the first unidirectional gate valve 511 at the lower end of the by-pass pipeline 51 to enter the by-pass pipeline 51 and then flows through a sealed housing 52 to continue to flow upwards, then passes through the first unidirectional gate valve 511 at the upper end of the by-pass pipeline 51 to enter the upper end of the tubular stub body 1, and then returns to the drilling platform along the annular space at the upper end of the tubular stub body 1. The fluid in this process has a certain pressure and flow velocity, and can drive an impeller 53 to rotate within the sealed housing 52, thereby driving a rotor of the water-wheel power generation device to rotate, and the rotor cuts a magnetic field of a stator to generate current. The water-wheel power generation device is connected to the power transmission interface 58 through a voltage stabilizing element 56, and the power transmission interface 58 is sealably connected to the power-on interface 4, thereby continuously supplying power to an acoustic wave generator 2.

The first opening pressure is set to be greater than a mud pressure at the depth of the first unidirectional gate valve during normal circulation, and the mud pressure at this depth can be simply calculated as: P=rou*g*H;

where rou is mud density, g is gravity acceleration, and H is depth of the first unidirectional gate valve (the depth from the turntable).

In the embodiment, the upper end and the lower end of the by-pass pipeline 51 are welded and fixed to the upper end and the lower end of the tubular stub body 1, respectively, and ports of the upper and lower by-pass pipeline 51 are each provided with a filtering device 57, to prevent rock debris in the drilling fluid from entering the by-pass pipeline 51. The filtering device may be a filter screen.

Furthermore, as shown in FIG. 1, in the embodiment, a first pipeline 551 and a second pipeline 552 are respectively disposed on both sides of the sealed housing 52 corresponding to the circumferential direction of the impeller 53, and a free end 5511 of the first pipeline 551 is a water inlet and is provided with a first threaded sealing cap 553, a free end 5521 of the second pipeline 552 is a water outlet and is provided with a second threaded sealing cap 554; square column-shaped operating levers 555 facilitating an underwater robot 500 to rotatablely open and close the threaded sealing caps are fixedly disposed on outer end faces of the first threaded sealing cap 553 and the second threaded sealing cap 554, respectively.

When hydrate is generated at the upper end or the lower end of the tubular stub body 1, the fluid cannot flow from the lower end of the tubular stub body 1 through the by-pass pipeline 51 to the upper end of the tubular stub body 1, at this time, by operating the underwater ROV, the first threaded sealing cap 553 and the second threaded sealing cap 554 can be unscrewed by a robot arm of the ROV in cooperation with the square column-shaped operating levers 555, seawater can enter the sealed housing 52 from the water inlet, and then flows out from the water outlet to form a circulation channel, thereby driving the impeller 53 to rotate to continuously generate power.

In order to facilitate the flow of seawater into the sealed housing 52, the first pipeline 551 and the second pipeline 552 are tapered pipelines that gradually expand to the free ends, respectively.

Further, as shown in FIG. 2, in the embodiment, a first branch line 541 is connected in parallel to one end of the by-pass pipeline 51, the first branch line 541 is communicated with the upper end inner cavity of the tubular stub body 1; a second branch line 542 is connected in parallel to the other end of the by-pass pipeline 51, the second branch line 542 is communicated with the lower end inner cavity of the tubular stub body 1; the first branch line 541 and the second branch line 542 are provided with a second unidirectional gate valve 543, respectively, and an opening direction of the second unidirectional gate valve 543 is that fluid flows from the first branch line to the second branch line (i.e., the fluid flows from the lower end of the tubular stub body 1 through the by-pass pipeline 51 to the upper end of the tubular stub body 1), the second unidirectional gate valve 543 is provided with a second opening pressure.

When hydrate is formed between the upper end and the lower end of the tubular stub body 1 and other channels are not available, a reverse circulation channel can be established, fluid inside an upper portion of the riser of the riser stub can be pressurized to compel the fluid in the upper portion of the riser to flow through the filtering device 57 to then enter the first branch line 541, the fluid at this time has high pressure, and when the fluid pressure reaches the second opening pressure set by the second unidirectional gate valve 543, the second unidirectional gate valve 543 opens unidirectionally, the fluid passes through the second unidirectional gate valve 543 of the first branch line 541 to enter the by-pass pipeline 51 and then flows through the sealed housing 52 to continue to flow downwards, then passes through the second unidirectional gate valve 543 of the second branch line 542 to enter the upper end of the tubular stub body 1, and then flows downwards along the annular space at the lower end of the tubular stub body 1. The fluid in this process has a certain pressure and flow velocity, and can drive an impeller 53 to rotate within the sealed housing 52, thereby causing the water-wheel power generation device to continuously supply power to the acoustic wave generator 2.

The second opening pressure is set to be greater than a mud pressure at this depth during normal circulation. Considering the greater depth of the seawater section, the mud pressure at this depth can be approximately taken as P in the first opening pressure. Meanwhile, the pressure shall be lower than an ultimate bearing capacity of each pipe string and equipment below the turntable and above the second unidirectional gate valve. Because a grouting pipeline used for on-site return circulation is basically not pressure bearable, it may be necessary to reserve a pressure bearable grouting pipeline if it is necessary to carry out return circulation suffocating, during the use of the tool.

Further, in the embodiment, the by-pass pipeline 51, the first branch line 541, the second branch line 542, the first pipeline 551, and the second pipeline 552 may also be used in cooperation with each other to form various kinds of fluid channels, to cause the fluid to drive the impeller 53 to rotate in the sealed housing, thereby causing the water-wheel power generation device to continuously generate power and to continuously supply power to the acoustic wave generator 2.

The riser stub 100 for acoustic resonance decomposition of hydrate in deepwater drilling according to the present invention is installed approximately near the seafloor mud line, for example, during installation, the riser above the underwater wellhead and the riser below the underwater wellhead are connected to the risers above and below thereof respectively by the first connection end 11 and the second connection end 12; in the embodiment, as shown in FIG. 1. The first connection end 11 and the second connection end 12 are threaded connection ends respectively, for example, the first connection end (an upper end) 11 is a female buckle, and the second connection end (a lower end) 12 is a male buckle; of course, the first connection end 11 and the second connection end 12 may also be clamping connection ends, respectively.

From the above mentioned, after the riser stub for acoustic resonance decomposition of hydrate in deepwater drilling is adopted, through continuous power-on, sound waves close to a simple harmonic vibration frequency of the hydrate are generated inside the pipeline to cause the hydrate in the riser to resonate, thereby being able to effectively avoid (prevent) formation of natural gas hydrate inside the pipeline; after the natural gas hydrate has been formed inside the pipeline, a power supply system of the riser stub will automatically start supplying power to the acoustic transducers, or the riser stub may be temporarily energized via a cable, by means of the acoustic waves, the natural gas hydrate blocking the pipeline is caused to resonate to break its equilibrium state and to be decomposed so as to realize de-blocking.

The foregoing is merely an illustrative embodiment of the invention and is not intended to limit the scope of the invention. Any equivalent changes and modifications made by those skilled in the art without departing from the concepts and principles of the present invention shall fall within the scope of the present invention.

REFERENCE SIGNS

100: riser stub for acoustic resonance decomposition of hydrate in deepwater drilling;
1: tubular stub body;
11: first connection end;
12: second connection end;

2: acoustic transducers;
3: water insulation layer;
4: power-on interface;
41: wire;
5: power supply system;
51: by-pass pipeline;
511: first unidirectional gate valve;
52: sealed housing;
53: impeller;
541: first branch line;
542: second branch line;
543: second unidirectional gate valve;
551: first pipeline; 5511: free end;
552: second pipeline; 5521: free end;
553: first threaded sealing cap;
554: second threaded sealing cap;
555: square column-shaped operating lever;
56: voltage stabilizing element;
57: filtering device;
58: power-on interface;
200: riser pipe;
300: external cable;
400: water-wheel power generation device;
500: underwater robot.

The invention claimed is:

1. A riser stub for acoustic resonance decomposition of hydrate in deepwater drilling, characterized in comprising a through tubular stub body, wherein the through tubular stub body includes a first and second connection ends connected to a riser at both ends thereof, respectively;

wherein a plurality of acoustic transducers are fixedly disposed on an outer wall surface of the through tubular stub body;

wherein an outer side of the through tubular stub body is covered with a water insulation layer, and the plurality of acoustic transducers are sealed between the through tubular stub body and the water insulation layer; and wherein the water insulation layer is further provided with a power-on interface that can be connected to a power supply, and the plurality of acoustic transducers are connected to the power-on interface.

2. The riser stub for acoustic resonance decomposition of hydrate in deepwater drilling according to claim 1, wherein the acoustic transducers are provided in a plurality of groups at intervals along a length direction of the through tubular stub body, and in each group, the acoustic transducers are evenly distributed along a circumferential direction of the through tubular stub body.

3. The riser stub for acoustic resonance decomposition of hydrate in deepwater drilling according to claim 1, wherein the power supply is an external cable being placed downward from a water surface drilling platform.

4. The riser stub for acoustic resonance decomposition of hydrate in deepwater drilling according to claim 1, wherein the power supply is a power supply system disposed outside the through tubular stub body.

5. The riser stub for acoustic resonance decomposition of hydrate in deepwater drilling according to claim 4, wherein the power supply system includes a by-pass pipeline, one end of which is communicated with a first end inner cavity of the through tubular stub body, and an other end of which is communicated with a second end inner cavity of the tubular stub body;

wherein the one end and the other end of the by-pass pipeline are respectively provided with a first unidirectional gate valve, and an opening direction of the first unidirectional gate valve is that fluid flows from the other end of the by-pass pipeline to the one end thereof, the first unidirectional gate valve is provided with a first opening pressure; and a sealed housing is arranged in the middle of the by-pass pipeline, and an impeller of a water-wheel power generation device is arranged within the sealed housing; the water-wheel power generation device is connected to a power transmission interface, which is sealably connected to the power-on interface.

6. The riser stub for acoustic resonance decomposition of hydrate in deepwater drilling according to claim 5, wherein a first branch line is connected in parallel to the one end of the by-pass pipeline, the first branch line is communicated with the first end inner cavity of the through tubular stub body;

a second branch line is connected in parallel to the other end of the by-pass pipeline, the second branch line is communicated with the second end inner cavity of the through tubular stub body; and the first branch line and the second branch line are provided with a second unidirectional gate valve, respectively, and an opening direction of the second unidirectional gate valve is that fluid flows from the first branch line to the second branch line, the second unidirectional gate valve is provided with a second opening pressure.

7. The riser stub for acoustic resonance decomposition of hydrate in deepwater drilling according to claim 5, wherein a first pipeline and a second pipeline are respectively disposed on opposite sides of the sealed housing corresponding to a circumferential direction of the impeller;

a free end of the first pipeline is a water inlet and is provided with a first threaded sealing cap;

a free end of the second pipeline is a water outlet and is provided with a second threaded sealing cap; and square column-shaped operating levers facilitating an underwater robot to rotatablely open and close the threaded sealing caps are fixedly disposed on outer end faces of the first threaded sealing cap and the second threaded sealing cap, respectively.

8. The riser stub for acoustic resonance decomposition of hydrate in deepwater drilling according to claim 7, wherein the first pipeline and the second pipeline are tapered pipelines that gradually expand to the free ends, respectively.

9. The riser stub for acoustic resonance decomposition of hydrate in deepwater drilling according to claim 6, wherein a first pipeline and a second pipeline are respectively disposed on opposite sides of the sealed housing corresponding to a circumferential direction of the impeller;

a free end of the first pipeline is a water inlet and is provided with a first threaded sealing cap;

a free end of the second pipeline is a water outlet and is provided with a second threaded sealing cap; and square column-shaped operating levers facilitating an underwater robot to rotatablely open and close the threaded sealing caps are fixedly disposed on outer end faces of the first threaded sealing cap and the second threaded sealing cap, respectively.

10. The riser stub for acoustic resonance decomposition of hydrate in deepwater drilling according to claim 9, wherein the first pipeline and the second pipeline are tapered pipelines that gradually expand to the free ends, respectively.

11. The riser stub for acoustic resonance decomposition of hydrate in deepwater drilling according to claim 1, wherein the water insulation layer is a ceramic insulation layer.

12. The riser stub for acoustic resonance decomposition of hydrate in deepwater drilling according to claim 1, wherein the first connection end and the second connection end are threaded connection ends or clamping connection ends, respectively.

* * * * *